US007276470B2

(12) United States Patent
Hahn

(10) Patent No.: US 7,276,470 B2
(45) Date of Patent: Oct. 2, 2007

(54) GLASSWARE CORROSION INHIBITOR

(75) Inventor: Karlheinz Ulrich Gerhard Hahn, Luwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 421 days.

(21) Appl. No.: 10/503,707

(22) PCT Filed: Dec. 19, 2002

(86) PCT No.: PCT/GB02/05780

§ 371 (c)(1),
(2), (4) Date: Aug. 5, 2004

(87) PCT Pub. No.: WO03/066798

PCT Pub. Date: Aug. 14, 2003

(65) Prior Publication Data

US 2005/0090417 A1 Apr. 28, 2005

(30) Foreign Application Priority Data

Feb. 9, 2002 (GB) ..... 0203126.8
Oct. 21, 2002 (GB) ..... 0224390.5

(51) Int. Cl.
*C11D 17/00* (2006.01)

(52) U.S. Cl. ..... 510/224; 510/445; 510/446

(58) Field of Classification Search ..... 510/220, 510/224, 445, 446
See application file for complete search history.

(56) References Cited

U.S. PATENT DOCUMENTS

| | | | | | |
|---|---|---|---|---|---|
| 2,575,576 | A | * | 11/1951 | Bacon et al. | 510/219 |
| 3,255,117 | A | | 6/1966 | Knapp et al. | 252/99 |
| 3,677,820 | A | | 7/1972 | Rutkowski | 134/25 A |
| 4,346,184 | A | * | 8/1982 | Drake | 523/451 |
| 4,443,270 | A | * | 4/1984 | Biard et al. | 134/25.2 |
| 4,545,917 | A | * | 10/1985 | Smith et al. | 510/224 |
| 6,299,701 | B1 | | 10/2001 | Aubay et al. | 134/42 |
| 6,622,736 | B1 | | 9/2003 | Hahn | 134/25.2 |

FOREIGN PATENT DOCUMENTS

| | | |
|---|---|---|
| EP | 0 393 482 A1 | 8/1990 |
| EP | 0 387 997 A1 | 9/1990 |
| EP | 1026230 A | 8/2000 |
| GB | 0107593 | 6/1918 |
| GB | 2 372 500 A | 8/2002 |
| JP | 2000144196 | 5/2000 |
| WO | WO 00/39259 A1 | 7/2000 |
| WO | WO 01/64823 A1 | 9/2001 |

* cited by examiner

*Primary Examiner*—Lorna M. Douyon
(74) *Attorney, Agent, or Firm*—Norris, McLaughlin & Marcus

(57) ABSTRACT

Article for use in a dishwashing machine, which comprises a water-soluble glass or ceramic composition effective to reduce corrosion of glassware and at least one surfactant containing composition, wherein the amount of the glass or ceramic composition is within the range of 5 to 95 wt. % and the amount of the surfactant is in the range of 5 to 95 wt. %, both percentages based on the weight of the article.

9 Claims, 2 Drawing Sheets

GLASSWARE CORROSION INHIBITOR

This is a 371 of PCT/GB02/05780 filed 19 Dec. 2002

BACKGROUND OF THE INVENTION

1. Field of the Invention

The invention is related to an article for use in a dishwashing machine to reduce corrosion of glassware.

2. The Related Art

Corrosion of glassware in cleaning and/or rinsing cycles of an automatic dishwashing machine is a well-known problem. This corrosion problem will create, after a certain number of cleaning cycles, damages on the glassware, such as turbidity, scratches, streaks and the like.

There are different approaches in the prior art proposed for the solution of above identified problems.

One approach is the use of zinc, either in metallic form (U.S. Pat. No. 3,677,820) or in the form of zinc compounds. The use of soluble zinc salts for inhibition of corrosion of glassware in automatic dishwashing processes is, for example, disclosed in U.S. Pat. No. 3,255,117.

Another approach is the use of insoluble zinc compounds for the inhibition of corrosion of glassware in automatic dishwashing processes as described in European Patent Application EP 0 383 480 A1, EP 0 383 482 A1 and EP 0 387 997 A1. More particularly insoluble zinc salts such as zinc silicate, zinc carbonate, zinc oxide, basic zinc carbonate, zinc hydroxide, zinc oxalate, zinc monophosphate and zinc pyrophosphate have been proposed. With these prior art compositions, it is disadvantageous that, due to the low solubility, or even insolubility, of the zinc compounds, it is difficult, if not impossible, to ensure an continuously sufficient amount of active corrosion inhibiting agent in the wash liquor or rinse water.

Patent applications WO 00/39259 A1, WO 01/64823 A1 and pending application GB 0104347 disclose the use of water-soluble glass and ceramic compositions, respectively, as corrosion protection for glassware. These compositions comprise at least one compound, which in cleaning and/or rinsing cycles of a dishwashing machine releases a corrosion-inhibiting agent.

It has been suggested that it may be advantageous to use such water-soluble glass or ceramic materials in the form of a large shaped body, which could be placed into the dishwasher and would allow a prolonged glass protection effect. However, the use of the glass or ceramic compositions in powder or granular form into conventional detergent or rinse compositions is also possible.

However, when actually testing the compositions described in WO 00/39259 a number of problems have become apparent.

A first problem found, in particular when the water-soluble glass or ceramic compositions are in the form of a shaped body, is that the shaped bodies show the undesirable tendency of developing sharp edges on dissolution. This is indeed a big problem for their use by the consumers particularly when large shaped bodies for several cycles are used as there is the potential risk that the consumer is injured when manipulating the contents of the dishwasher (plates, cutlery . . . ) in the vicinity of the region where the partially dissolved shaped bodies having developed sharp edges are to be found.

The applicant has tried to find a solution to the problem of the shaped bodies developing sharp edges by giving the shaped bodies different shapes in the hope to find a shape, which will avoid the development of the "sharp edges". This route has, however, proven to be not sufficient to fully solve the problem.

A second problem is that, when the shaped body is added to the dishwasher without taking special measures to control its free movement within the machine, it may end up sitting in the bottom of the machine reservoir close to the heating elements of the dishwasher. This will have the undesirable effect of substantially increasing the dissolution rate of the shaped body thereby unnecessarily shortening its lifetime. Alternatively the glass may get stacked in a place within the dishwasher where it is poorly exposed to the washing liquor. This will result in a sub-optimal glass-protecting performance.

Although the above-mentioned disadvantages would be solved by instructing the consumer to place the shaped body in an existing predetermined position of the dishwasher where its capacity to move is restricted, this may also cause problems.

The straightforward point to place the shaped body if one wants to restrict its movement is the cutlery basket.

However, placing the shaped body in the cutlery basket has also a number of disadvantages for the consumer. One clear disadvantage is that it occupies space the consumer would have used to place its cutlery thereby reducing the efficiency of the cleaning process as fewer cutleries per wash can be placed in the dishwasher. Another disadvantage is that once the shaped body is sitting in the cutlery basket, the consumer may drop cutlery in the compartment occupied by the shaped body causing it to break with the risk that the consumer is then injured by the broken glass or that small pieces of glass or ceramic may damage the dishwasher.

Still a third problem of using the glass shaped bodies in the dishwasher arises from the thermal shock they have to face when hot washing liquor is pumped off the machine and new fresh cold water enters the machine in a short time period. This thermal shock may again cause the shaped body to break with the associated problems described above.

A solution for these problems have been proposed in unpublished British Patent Application GB 0107593, the disclosure of which is incorporated herein by reference. The solution described in this patent application is characterized by a kit for use in a dishwashing machine to dispense a water-soluble glass or ceramic composition into the machine over a plurality of dishwashing cycles, comprising (a) a shaped body made of the water-soluble glass or ceramic composition; and (b) a container preferably made of plastic material for holding said shaped body with at least part of its walls having perforations allowing a controlled circulation of the wash liquor into and out of the container.

However, during the use of such kit, formation of a viscous, gelatinous layer on the surface of the shaped body has been observed. This layer may result in adhesion of the shaped body onto the walls of the container, or in the formation of material clogging the perforations in the walls of the container, thus at least partly blocking off the circulation of the wash liquor into and out of the container. This is in particular true with perforations of a size of less than 7 mm which are preferably chosen for safety reasons, i.e. to avoid larger particles to exit from the container into the dishwashing machine.

A further area where there is room for improvement is that of the stability of water-soluble glass or ceramic glassware protecting compositions. It has been observed that these compositions are sensitive to humidity, which can cause changes in the appearance of the compositions during storage. It has also been found that there is a direct relationship between the water-solubility of the composition and its sensitivity to humidity, which make highly soluble compositions more prone to develop undesired appearance changes when exposed to humidity than those occurring with compositions having lower dissolution rates.

It is however desirable to use compositions with a relatively high rate of dissolution in order to guarantee a sufficient release of the glass-protecting composition to the washing liquors. Therefore the need remains to find ways of improving the rate of dissolution of the compositions in the dishwasher without impairing the sensitivity to moisture.

The object of the present invention is to avoid the above-mentioned specific problems and/or to improve the dissolution of the glass or ceramic composition.

SUMMARY OF THE INVENTION

Surprisingly, these problems have been found to be alleviated or eliminated when the article comprises a water-soluble glass or ceramic composition effective to reduce corrosion of glassware and at least one surfactant wherein the amount of the glass or ceramic composition is within the range of 5 to 95 wt. % and the amount of the surfactant is in the range of 5 to 95 wt. %, both percentages based on the weight of the article.

DETAILED DESCRIPTION OF THE INVENTION

Figure 1:
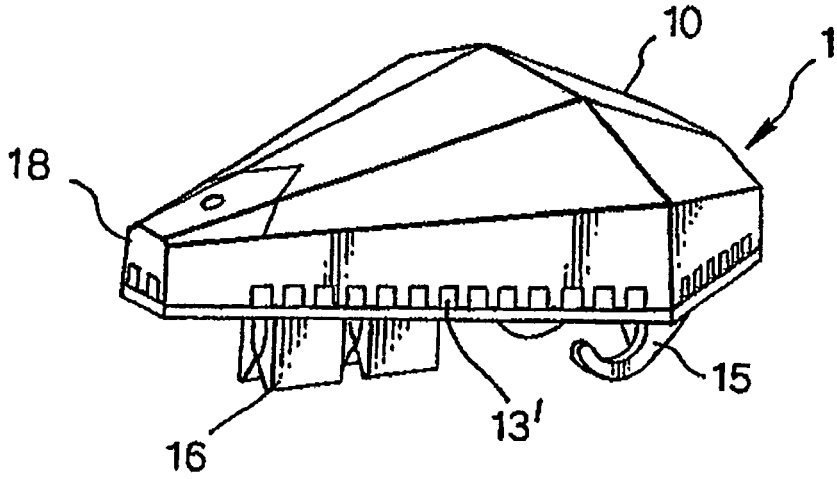
FIG. 1 shows a perspective view of one preferred embodiment of the kit of the present invention.

In one alternative embodiment of the invention the water-soluble glass or ceramic composition is (at least partially) in the form of a particulate or fiber-like material dispersed within a water-soluble matrix.

In a particular execution the water-soluble matrix comprises the surfactant containing composition optionally mixed with solubility control materials to form a solid composition. Non-limiting examples of such materials are polyethyleneglycols, non-ionic amine polyglycol condensates, fatty acid alkanolamides and high molecular weight fatty acids.

In one specific embodiment of the invention the surfactant is provided in the form of a liquid composition contained in a reservoir from where it can leach or be dispensed by any suitable control release mechanism.

In another specific embodiment of the invention the water-soluble glass or ceramic composition is held in a container with at least part of its walls having perforations allowing a controlled circulation of the washing liquor into an out of the container, wherein the surfactant containing composition is optionally also contained within the container. The water-soluble glass or ceramic composition is in the form of a shaped body.

It is also envisaged that the composition comprising the surfactant(s) is at least partly located within the container such that said composition, when the container is fixed in the dishwashing machine, comes into contact with the wash liquor earlier than the water-soluble glass or ceramic composition to form a surfactant containing wash liquor which will subsequently get into contact with the water-soluble glass or ceramic composition.

In one alternative of the invention, the composition comprising the surfactant(s) is held adjacent and in direct contact with the shaped glass or ceramic body.

The shaped body may comprise at least one mould in at least one of its surfaces, said mould(s) being at least partly filled with the composition comprising the surfactant(s).

In another alternative embodiment of the invention, the shaped body and the surfactant-containing composition are held in separate compartments of the container.

The ratio of the water-soluble glass or ceramic composition to the surfactant(s) may be such that both the water-soluble glass or ceramic composition and the surfactant(s) are present in an effective amount for essentially the same number of dishwashing cycles, wherein a preferred ratio varies within a range of from 1:10 to 10:1, more preferably within a range of from 1:5 to 5:1.

Experiments with a number of surfactant compositions being hold within the container have shown substantially reduced adhesion of the shaped body to the walls of the container and substantially less clogging of the perforations within the walls.

It has also surprisingly been found that the presence of the surfactant ameliorates the rate of dissolution of the glass or ceramic compositions, also when they are in the form of powder, fibers or granules.

It is to be understood that, although the preferred embodiment of the invention is directed to an article which comprises a composition mainly consisting of the water-soluble glass or ceramic composition and the surfactant(s) only, further ingredients could be incorporated unless they do not affect the proper function and interaction of the two components as explained herein. However, the minimum amounts of both the glass or ceramic composition and of the surfactant(s) is 5 wt. %, based on the weight of the article, i.e. compositions having minor amounts of a water-soluble glass or ceramic composition for reducing corrosion of glassware and/or surfactant(s) of less than 5 wt. % are not seen to be within the scope of the present invention.

Although all kinds of surfactants or mixtures thereof may be used, surfactants with good sheeting characteristics are preferred. It has been found that a correlation exists between the contact angle between polyethylene and a solution made by dissolving 100 ppm of surfactant in distilled water measured according to the method described below.

Method of Measuring Contact Angle of Surfactant Solutions:

A contact angle tester Dataphysics OCA 15 Plus was used to effect the measurements following a method inspired on the method described on the ASTM standard D 5725. The automatic set-up option of the apparatus was used to perform the measurements.

Prior to the test a strip of polyethylene was cleaned with ethanol using a cellulose tissue. Then a 100-ppm aqueous solution of the surfactant to be tested was dosed on the strip by a 1 ml pump-driven syringe.

Then the tester performs a dynamic determination of the contact angle between the surfactant solution and the polyethylene strip in the time frame of 0 to 5 s.

Preferred surfactants according to the invention show a contact angle (measured following the method described above) below 100°; preferably below 90°, most preferred below 80°, still most preferred below 75°. (Water=105°±5°; LF305=70 °±5° at 0.5 s. declining to 60°±5° after 5.0 s.

It is also preferred that the surfactant is selected from the group consisting of low-foaming, preferably nonionic surfactants.

Although there are no specific limitations of the form of how to incorporate the surfactant-containing composition into a container holding a large shaped body of glass or ceramic composition for glass protection, some specific embodiments have been envisaged to be preferred.

One embodiment is to provide for at least one mould in at least one of the surfaces of the shaped body made of the water-soluble glass or ceramic composition, said mould(s) being at least partly filled with the composition comprising the surfactant(s). This embodiment is shown in more detail in the drawing and described hereinbelow.

However, the beneficial effects of the invention can also be achieved by surfactant-containing compositions, e.g. as a solidified mass held adjacent and in direct contact with the shaped body. In an alternative embodiment the container may comprise separate compartments to hold the separate compositions, namely the water-soluble glass or ceramic composition on the one hand, and the surfactant-containing composition on the other hand.

The invention is not limited to an embodiment where the surfactant-containing composition is present in a form of a unitary solidified mass (either as a separate block or as a filling of mould in the shaped body made of the water-soluble glass or ceramic composition), but also comprises an embodiment where the surfactant may be present in a form of particulate material such as granules or pellets, for example, held in a separate compartment of the container being accessible by the wash liquor via appropriately dimensioned perforations.

Now referring to FIG. 1, a kit 1 according to the present invention comprises a container 10 for holding the shaped body made of water-soluble glass or ceramic composition (not shown in this drawing) as well as means 15, 16 provided on the container 10 to fix it to a pre-determined position within the dishwashing machine. In this preferred embodiment, the fixing means consist of hooks 15 and clips 16 to enable the fixation of the kit 1, preferably at vertical or horizontal parts of the racks. Vertical fixation on the upper rack is most preferred for this embodiment of kit 1.

Figure 2:
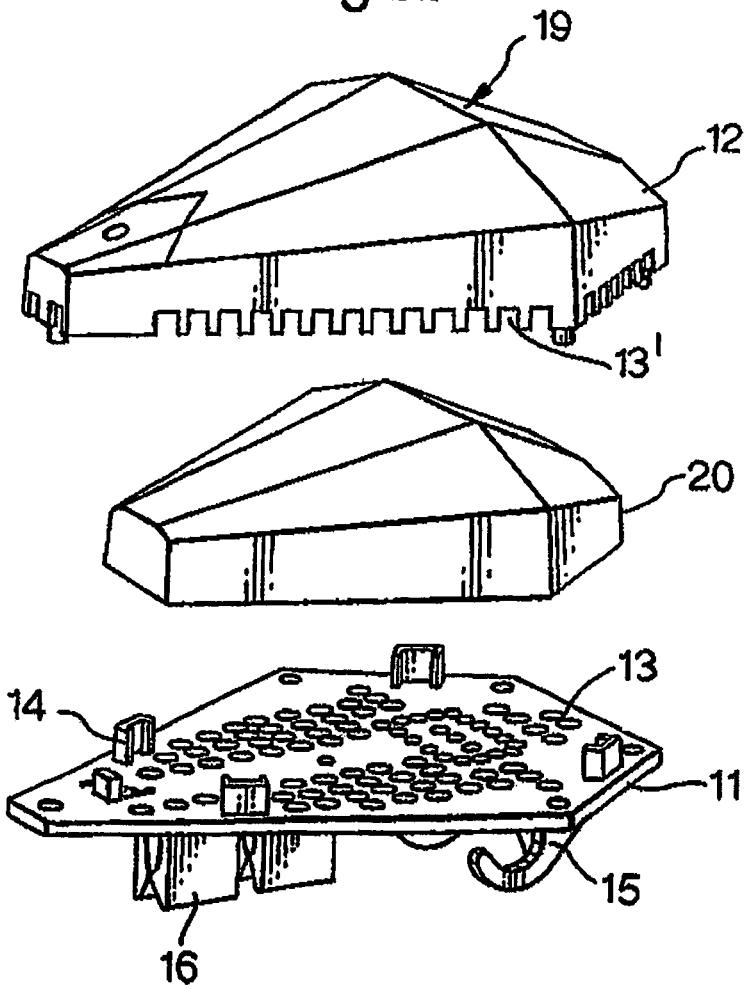
FIG. 2 shows an exploded view of the embodiment of FIG. 1.

More details can be seen from FIG. 2, which is an exploded view. Both the base plate 11 and the cover 12 of the container 10 provides for a number of perforations (holes) 13 and 13' allowing a controlled circulation of the wash liquor into and out of the container. The control of the circulation is by means of the number and size of the holes 13 and 13' and by the spacing means 17 and 17' in the cover 12 and in the base plate 11 of the container. Moreover, on the upper side of the base plate 11 means 14 for fixation of the cover 12 of the container 10 are provided for. It is to be noted that the kit is made of two parts, namely the base plate 11 and the cover 12, to enable the introduction of the shaped body 20 during the manufacturing process. It is, however, preferred that the container cannot be easily, at least not without irreversible destruction thereof, disassembled by the consumer to prevent that he can be injured by sharp edges of the partially dissolved glass or ceramic shaped body 20. At least part of cover 12 of the container can be made transparent for additionally viewing the shaped body 20, and also for aesthetic reasons.

Figure 3:
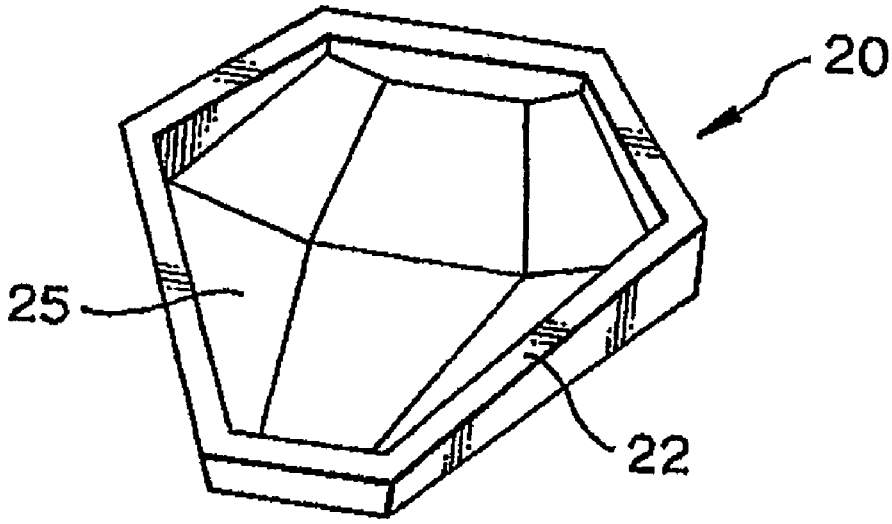
FIG. 3 shows a view of the surface of the shaped body facing the flat base plate of the container with a mould formed therein.
Figure 4:
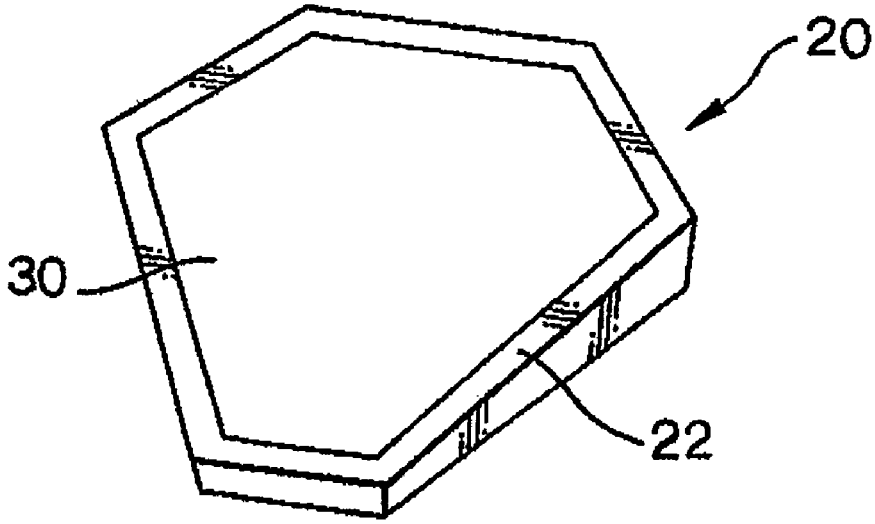
FIG. 4 shows the shaped body of FIG. 3 wherein the mould is filled with a surfactant-containing composition.

FIG. 3 shows surface 22 of the shaped body 20 facing the base plate 11 of the container 10. In said surface 22 a mould 25 is formed to receive and hold the surfactant containing composition 30, which can be seen from FIG. 4 as a filling of mould 25.

Experimental Results

To evaluate the benefit of adding a surfactant-containing composition to a kit as described hereinabove, experimental tests have been made with a kit with and without the addition of such surfactant-containing composition.

It has been observed that there is significantly less formation of a viscous, gelatinous layer on the surface of the shaped body made of the water-soluble glass or ceramic composition, and a simultaneous increase in the solubility of the shaped body.

For the tests, a 15 g shaped body made of a water-soluble glass composition as detailed in table 1 has been placed in a cage of plastic material with perforations to form a kit as shown in the FIG. 1. In the embodiment according to the present invention a 5 g block of a surfactant containing composition as detailed in table 2 has been placed within the cage on top of the water-soluble glass composition as shown in FIG. 2.

TABLE 1

| | |
|---|---|
| $P_2O_5$: | 49.25 |
| $Na_2O$: | 1 |
| $K_2O$: | 26.75 |
| $B_2O_2$: | 1.5 |
| CaO: | 2 |
| $SiO_2$: | 2 |
| ZnO: | 17.5 |

TABLE 2

| | |
|---|---|
| Ethoxylated alcohol (Plurafac RA30) | 19.69 |
| Amine polyglycol condensate (Triton CF 32) | 15.31 |
| Polyethylene glycol MW = 8000 | 42.499 |
| Fatty acid monoethanolamide | 21 |
| Perfume | 1.5 |
| Lemon Juice | 0.001 |
| . . . | |

While adhesion of the shaped body to the inner surfaces of the shaped body can be observed in all cases without an additional surfactant-containing composition within the container, no or almost no such adhesion occurred when using such composition. Also, no clogging of the perforations in the base plate 11 of the container 10 and only little clogging of the perforations 13' on the side walls of the container were observed with the use of the additional surfactant-containing composition, whereas substantial clogging of all perforations occurred without such composition. Additionally a 20% increase in the solubility of the glass has been observed when the surfactant composition was present.

The features disclosed in the foregoing description, the claims and the drawing may, both separately and in any combination thereof, be material for realizing the invention in diverse forms thereof.

The invention claimed is:

1. Article for use in a dishwashing machine, which comprises a water-soluble zinc glass or ceramic composition which is at least partially in the form of a shaped body, effective to reduce corrosion of glassware, and a surfactant composition, wherein the amount of the glass or ceramic composition is within the range of 5 to 95 wt. % and the amount of surfactant is in the range of 5 to 95 wt. %, both percentages being based on the weight of the article and wherein the shaped body comprises at least one mold in at least one of its surfaces, the mold being at least partly filled with the surfactant-containing composition.

2. Article according to claim 1 wherein the surfactant has a contact angle below 100°.

3. Article according to claim 2, wherein said contact angle is below 90°.

4. Article according to claim 3, wherein said contact angle is below 80°.

5. Article according to claim 4, wherein said contact angle is below 75°.

6. Article according to claim 2, wherein the surfactant is selected from the group consisting of low foaming surfactants.

7. Article according to claim 1 wherein the ratio of the water-soluble glass/ceramic composition to the surfactant is selected to provide an effective amount of both the water-soluble glass or ceramic composition and the surfactant for essentially the same number of dishwashing cycles.

8. Article according to claim 7, wherein the ratio of the water-soluble glass/ceramic composition to the surfactant is from 1:10 to 10:1.

9. Article according to claim 8, wherein said ratio is from 1:5 to 5:1.

* * * * *